US008367006B2

(12) United States Patent
Machi et al.

(10) Patent No.: US 8,367,006 B2
(45) Date of Patent: Feb. 5, 2013

(54) PLATINUM MICROPARTICLES GENERATOR

(75) Inventors: Masaharu Machi, Osaka (JP); Hiroshi Suda, Takatsuki (JP); Yasuhiro Komura, Shijonawate (JP)

(73) Assignee: Panasonic Corporation, Kadoma-shi (JP)

( * ) Notice: Subject to any disclaimer, the term of this patent is extended or adjusted under 35 U.S.C. 154(b) by 28 days.

(21) Appl. No.: 13/138,127

(22) PCT Filed: Jan. 22, 2010

(86) PCT No.: PCT/JP2010/050799

§ 371 (c)(1),
(2), (4) Date: Jul. 11, 2011

(87) PCT Pub. No.: WO2010/087285

PCT Pub. Date: Aug. 5, 2010

(65) Prior Publication Data

US 2011/0268619 A1 Nov. 3, 2011

(30) Foreign Application Priority Data

| | | |
|---|---|---|
| Jan. 27, 2009 | (JP) | 2009-015948 |
| Jan. 27, 2009 | (JP) | 2009-015970 |
| Aug. 18, 2009 | (JP) | 2009-189046 |
| Aug. 18, 2009 | (JP) | 2009-189047 |

(51) Int. Cl.
*B01J 19/08* (2006.01)
*A45D 20/10* (2006.01)

(52) U.S. Cl. ..... 422/186.04; 34/97

(58) Field of Classification Search ..... 422/186.04; 34/97

See application file for complete search history.

(56) References Cited

FOREIGN PATENT DOCUMENTS

| | | | |
|---|---|---|---|
| JP | 2001-189199 | A | 7/2001 |
| JP | 2002-065344 | A | 3/2002 |
| JP | 2007-305418 | A | 11/2007 |
| JP | 2008-023063 | A | 2/2008 |
| JP | 2008-266747 | A | 11/2008 |

OTHER PUBLICATIONS

International Search Report dated Feb. 23, 2010, issued for PCT/JP2010/050799.

*Primary Examiner* — Kishor Mayekar
(74) *Attorney, Agent, or Firm* — Edwards Wildman Palmer LLP

(57) ABSTRACT

A platinum microparticles generator comprises a linear first electrode, a board-shaped second electrode, and an applying means. The first electrode contains at least platinum. The second electrode comprises an outlet opening, which is a circular through-hole, located so as to face one end of the first electrode. The applying means applies a voltage between the first and second electrodes. Then, the first electrode has an outside diameter in a range of 0.03 [mm] to 0.10 [mm]. Further, the outlet opening has an inside diameter in a range of 1.0 [mm] to 4.5 [mm]. Thus, the platinum microparticles generator can emit a sufficient amount of platinum microparticles while restraining generation of ozone.

4 Claims, 7 Drawing Sheets

PLATINUM MICROPARTICLES GENERATOR

TECHNICAL FIELD

The present invention relates generally to platinum microparticles generators, and more particularly to a platinum microparticles generator that emits platinum microparticles produced by an electric discharge and protects hairs from damage caused by active oxygen.

BACKGROUND ART

In general, it is known that hears produce active oxygen when being exposed to ultraviolet rays and are damaged by the active oxygen and thus the damage causes to remove hair cuticles. Also, it is know that platinum provides antioxidant effect. Thus, in the past, there have been proposed various types of platinum microparticles generators which emit platinum microparticles produced by an electric discharge and protect hairs from damage caused by the active oxygen. One such example is described in Japanese Patent Application Laid-Open No. 2008-23063 published on Feb. 7, 2008. This platinum microparticles generator comprises a linear first electrode, a board-shaped second electrode and an applying means for applying a voltage between the first and second electrodes. The first electrode contains at least platinum. The second electrode comprises an outlet opening, which is a circular through-hole, located so as to face one end of the first electrode. Then, a part of the platinum contained in the first electrode is converted to microparticles by the electric discharge produced between the first and second electrodes, and the microparticles are emitted outward through the outlet opening.

By the way, the platinum microparticles generator generates ozone with the electric discharge inevitably. The higher the ozone density becomes, the more the ozone becomes harmful to a human body. Therefore, it is hoped that generation of the ozone is restrained. In contrast, there is an idea that a voltage applied by the applying means is reduced and a current value of the electric discharge is held down and thereby generation of the ozone is restrained. However, the above-mentioned platinum microparticles generator has a problem not to be able to emit a sufficient amount of platinum microparticles, if the current value is held down.

DISCLOSURE OF THE INVENTION

It is an object of the present invention to provide a platinum microparticles generator which can emit a sufficient amount of platinum microparticles while restraining generation of ozone.

A platinum microparticles generator of the present invention comprises a linear first electrode, a board-shaped second electrode, and an applying means. The first electrode contains at least platinum. The second electrode comprises an outlet opening, which is a circular through-hole, located so as to face one end of the first electrode. The applying means applies a voltage between the first and second electrodes. In a first feature of the present invention, the first electrode has an outside diameter in a range of 0.03 [mm] to 0.10 [mm], and the outlet opening has an inside diameter in a range of 1.0 [mm] to 4.5 [mm]. In the present invention, because the outlet opening has the inside diameter in the range of 1.0 [mm] to 4.5 [mm] under a condition that the first electrode has the outside diameter in the range of 0.03 [mm] to 0.10 [mm], the platinum microparticles generator, which can emit a sufficient amount of platinum microparticles while restraining generation of ozone without increase or decrease of the current value of the electric discharge, can be provided.

In one embodiment, said one end of the first electrode has a flat surface being perpendicular to a longitudinal direction of the first electrode. In the present invention, because said one end of the first electrode has the flat surface being perpendicular to the longitudinal direction of the first electrode, the platinum microparticles generator can inhibit the platinum microparticles emission from decreasing on a sudden with progress of use time.

In one embodiment, the inside diameter of the outlet opening is set to a value in a range of 1.5 [mm] to 2.0 [mm]. In the present invention, because the inside diameter of the outlet opening is set to a value in a range of 1.5 [mm] to 2.0 [mm], the platinum microparticles generator can emit a more sufficient amount of platinum microparticles without increase or decrease of the current value of the electric discharge.

BRIEF DESCRIPTION OF THE DRAWINGS

Preferred embodiments of the invention will now be described in further details. Other features and advantages of the present invention will become better understood with regard to the following detailed description and accompanying drawings where:

FIGS. 5A and 5B are illustrations which show lines of electric force between both the first and second electrodes according to said embodiment of the present invention, wherein FIG. 5A shows the lines in a case where the outside diameter of the first electrode is set to 0.15 [mm], and FIG. 5B shows the lines in a case where the outside diameter of the first electrode is set to 0.25 [mm];

FIGS. 8A and 8B are illustrations which show lines of electric force between both the first and second electrodes according to said embodiment of the present invention, wherein FIG. 8A shows the lines in a case where the inside diameter of the outlet opening is set to 1.5 [mm], and FIG. 8B shows the lines in a case where the inside diameter of the outlet opening is set to 3.0 [mm];

BEST MODE FOR CARRYING OUT THE INVENTION

Figure 1:
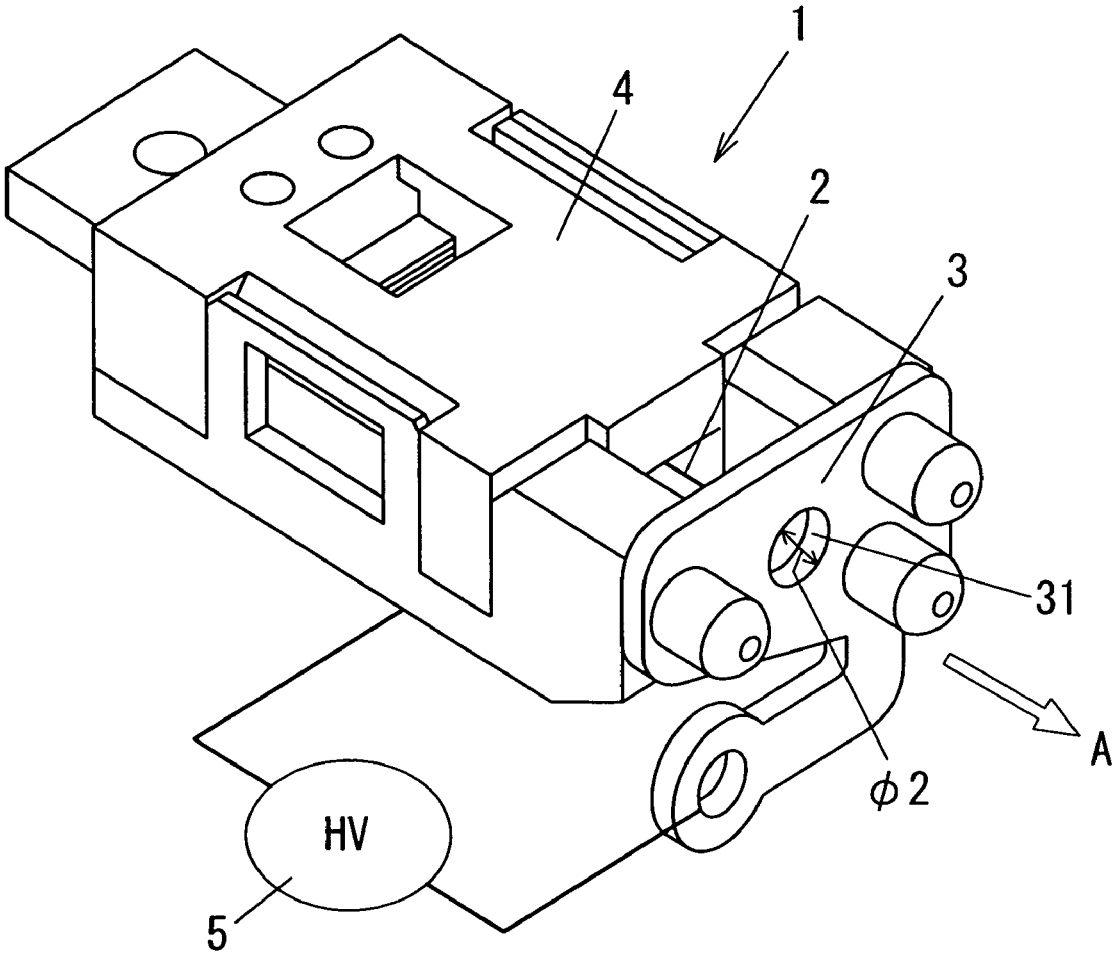
FIG. 1 is an oblique perspective figure of a platinum microparticles generator according to an embodiment of the present invention.

Hereinafter, an embodiment of the present invention will be described with reference to FIGS. 1 to 10. A platinum microparticles generator 1 of the embodiment comprises a first electrode 2, a second electrode 3, a housing 4, and an applying means 5, as shown in FIG. 1.

Figure 2:
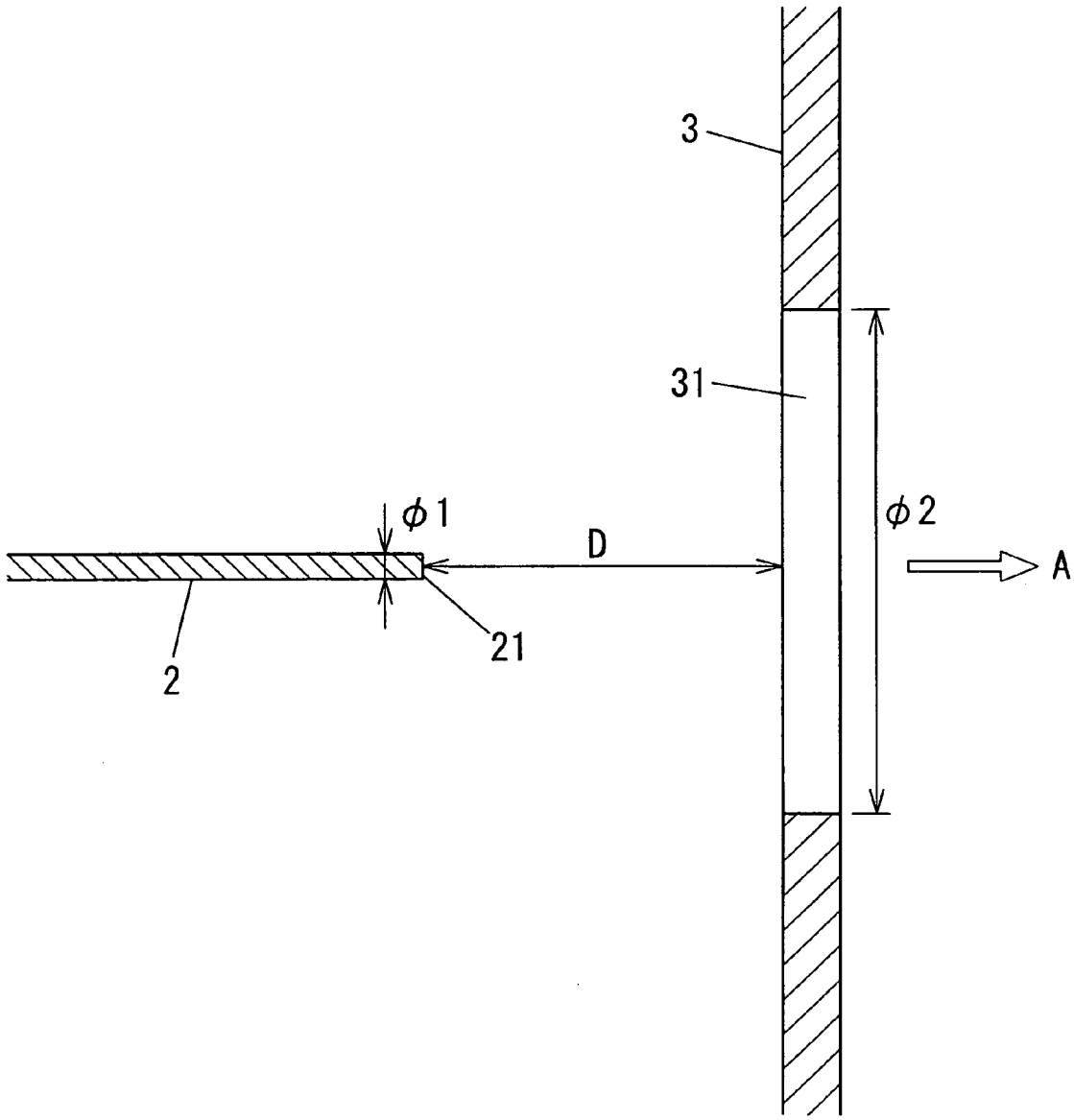
FIG. 2 is a cross-section view of first and second electrodes according to said embodiment of the present invention.

As shown in FIGS. 1 and 2, the first electrode 2 is formed into a thin linearity, and has an outside diameter ϕ1, and is made of platinum or platinum-plated metal or platinum-plated alloy. In addition, one end of the first electrode 2 does not have a surface formed into a radical shape or a sphere shape, but has a flat surface 21 being perpendicular to a longitudinal direction of the first electrode 2.

As shown in FIGS. 1 and 2, the second electrode 3 is made of stainless steel and is formed into a flat board-shape. Then, the second electrode 3 is located in a place across only a distance D (1.5 [mm]) in the longitudinal direction to the flat surface 21 of the first electrode 2. Then, the second electrode 3 comprises an outlet opening 31 located so as to face said one end of the first electrode 2. The outlet opening 31 is a circular through-hole having an inside diameter ϕ2.

As shown in FIG. 1, the housing 4 is made of, for example, polycarbonate resin and is formed into generally a rectangular box shape and supports the first and second electrodes 2, 3 in predetermined positions, respectively. The applying means 5 applies a voltage between the first and second electrodes 2, 3 and comprises a high voltage generating circuit with an igniter method, as shown in FIG. 1.

Then, the applying means 5 applies a high voltage to generate platinum microparticles so that the first and second electrodes 2, 3 become negative and positive electrodes, respectively. Then, an electric discharge is produced between the flat surface 21 of the first electrode 2 and the second electrode 3. Then, positive ions are pulled to a side of the first electrode 2, which is the negative electrode, and collides with the flat surface 21. As a result, a part of platinum contained in the first electrode 2 is converted to platinum microparticles by a sputtering phenomenon. Then, the platinum microparticles are emitted to a side of the second electrode 3. Then, the platinum microparticles are emitted in a direction of an arrowed line A shown in FIGS. 1 and 2.

Figure 3:
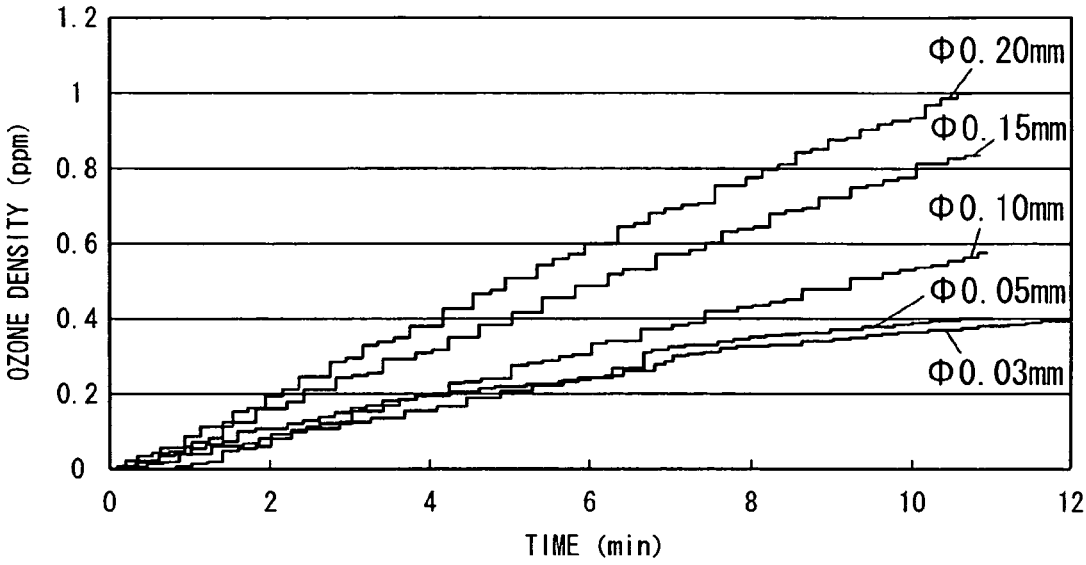
FIG. 3 is a characteristic figure which shows relations of an ozone density and an outside diameter of the first electrode according to said embodiment of the present invention.

In the platinum microparticles generator 1, a change in an amount of ozone, which is generated when the outside diameter ϕ1 of the first electrode 2 is variously changed in a range of 0.03 [mm] to 0.20 [mm], will be described with reference to FIG. 3. In addition, a horizontal axis in FIG. 3 shows a time (min) that has passed since the applying means 5 starts to apply the high voltage, and then a vertical axis in FIG. 3 shows a density (ppm) of the ozone, which is generated by the platinum microparticles generator 1. However, a value of a current, flowing by the electric discharge, is set so as to always become constant (e.g., 35 [μA]) in every value of the outside diameter ϕ1.

As shown in FIG. 3, the smaller the outside diameter ϕ1 of the first electrode 2 becomes, the more the ozone generation decreases. In particular, the ozone density becomes a value in a range of about 0.8 [ppm] to 1.0 [ppm] in 10 minutes when the outside diameter ϕ1 is set to be in a range of 0.15 [mm] to 0.20 [mm]. In contrast, the ozone density becomes 0.572 [ppm] in 10 minutes when the outside diameter ϕ1 is set to 0.10 [mm], and that is, it is found that the ozone density can be reduced in about half of the ozone density in the range of 0.15 [mm] to 0.20 [mm].

Figure 4:
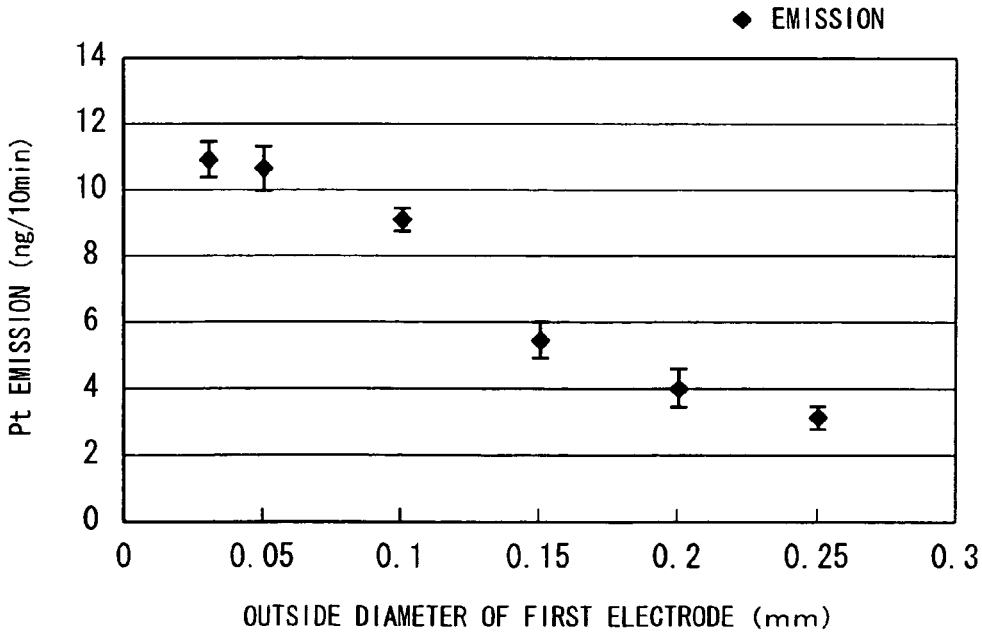
FIG. 4 is a characteristic figure which shows relations of a platinum microparticles emission and an outside diameter of the first electrode according to said embodiment of the present invention.

Then, a change in an amount of platinum microparticles, which is emitted when the outside diameter ϕ1 is variously changed in a range of 0.03 [mm] to 0.25 [mm], will be described with reference to FIG. 4. In addition, a horizontal axis in FIG. 4 shows the outside diameter ϕ1 (mm), and then a vertical axis in FIG. 4 shows the amount of the platinum microparticles (ng/10 min) emitted in the direction of the arrowed line A through the outlet opening 31. However, the current value is set so as to always become constant, as well as FIG. 3.

As shown in FIG. 4, the smaller the outside diameter ϕ1 becomes, the more the platinum microparticles emission increases. In particular, the amount of the emitted platinum microparticles becomes a value in a range of 3.3 [ng/10 min] to 5.3 [ng/10 min] when the outside diameter ϕ1 is set to be in a range of 0.15 [mm] to 0.25 [mm]. In contrast, the amount of the emitted platinum microparticles becomes a value in a range of 8.0 [ng/10 min] to 10.9 [ng/10 min] when the outside diameter ϕ1 is set to be in a range of 0.03 [mm] to 0.10 [mm], and that is, it is found that the amount of the emitted platinum microparticles becomes about twice as much as that in the range of 0.15 [mm] to 0.25 [mm].

Thus, as the reason that the smaller the outside diameter ϕ1 becomes the more the platinum microparticles emission increases, for example, an influence of an electric field strength is considered. In other words, it is considered that the smaller the outside diameter ϕ1 becomes, the more an electric line of force concentrates on the flat surface 21 and the more the platinum microparticles emitted by the sputtering phenomenon increases.

Figure 5A:
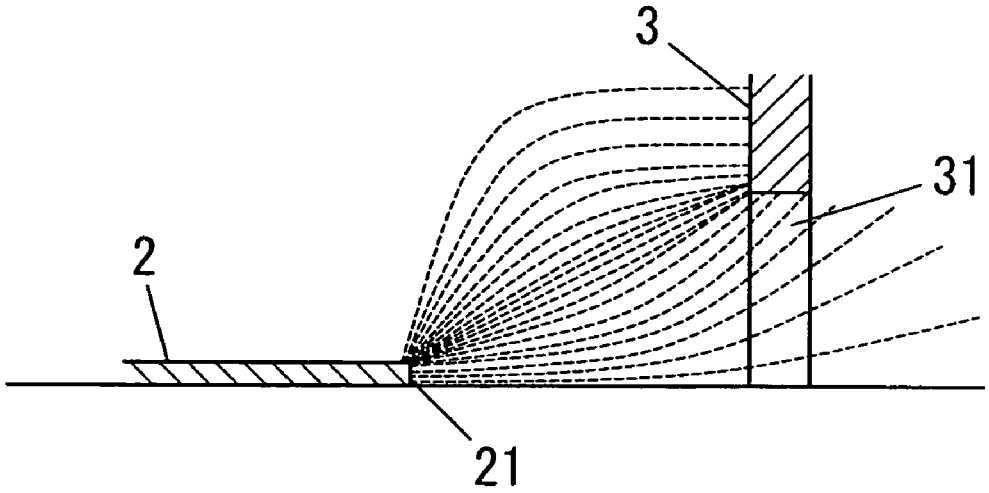
Figure 5B:
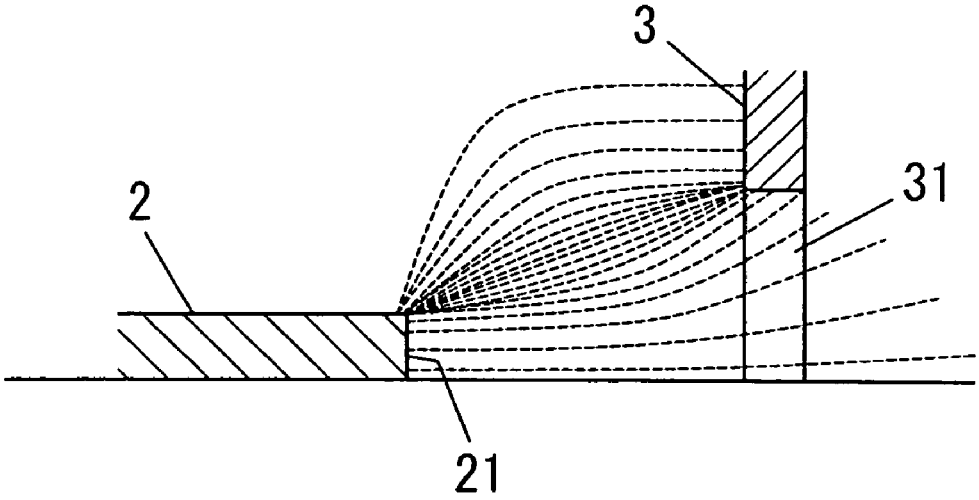

FIG. 5A shows the look of the electric line of force, which is produced between the first and second electrodes 2, 3 when the outside diameter ϕ1 is set to 0.15 [mm]. Then, FIG. 5B shows the look of the electric line of force, which is produced between the first and second electrode 2, 3 when the outside diameter ϕ1 is set to 0.25 [mm]. As can be expected from a density of the electric line of force in FIGS. 5A and 5B, the smaller the outside diameter ϕ1 becomes, the more the electric field strength around the flat surface 21 increases.

Figure 6:
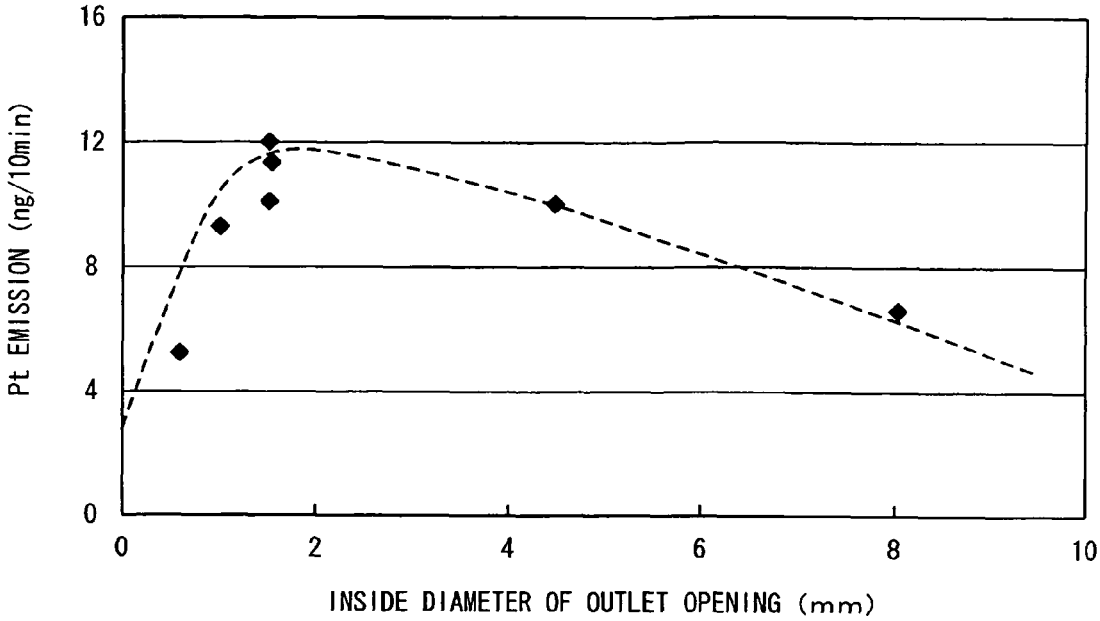
FIG. 6 is a characteristic figure which shows relations of a platinum microparticles emission and an inside diameter of the outlet opening according to said embodiment of the present invention.

Then, a change in an amount of platinum microparticles, which is emitted when the inside diameter ϕ2 of the outlet opening 31 is variously changed, will be described with reference to FIG. 6. In addition, a horizontal axis in FIG. 6 shows the inside diameter ϕ2 (mm), and then a vertical axis in FIG. 6 shows the amount of the platinum microparticles (ng/10 min) emitted in the direction of the arrowed line A through the outlet opening 31. However, a value of a current, flowing by the electric discharge, is set so as to always become constant (e.g., 35 [μA]) in every value of the inside diameter ϕ2.

As shown in FIG. 6, the smaller the inside diameter ϕ2 becomes, the more the platinum microparticles emission increases. Then, when the inside diameter ϕ2 is in a range of 1.0 [mm] to 4.5 [mm], the amount of the emitted platinum microparticles is in a range of 9 [ng/10 min] to 12 [ng/10 min] and is equivalent to or more than about 75% of a peak value (12 [ng/10 min]). In addition, when the inside diameter ϕ2 is in a range of 1.5 [mm] to 2.0 [mm], the amount of the emitted platinum microparticles is equivalent to or more than about 90% of said peak value.

Figure 7:
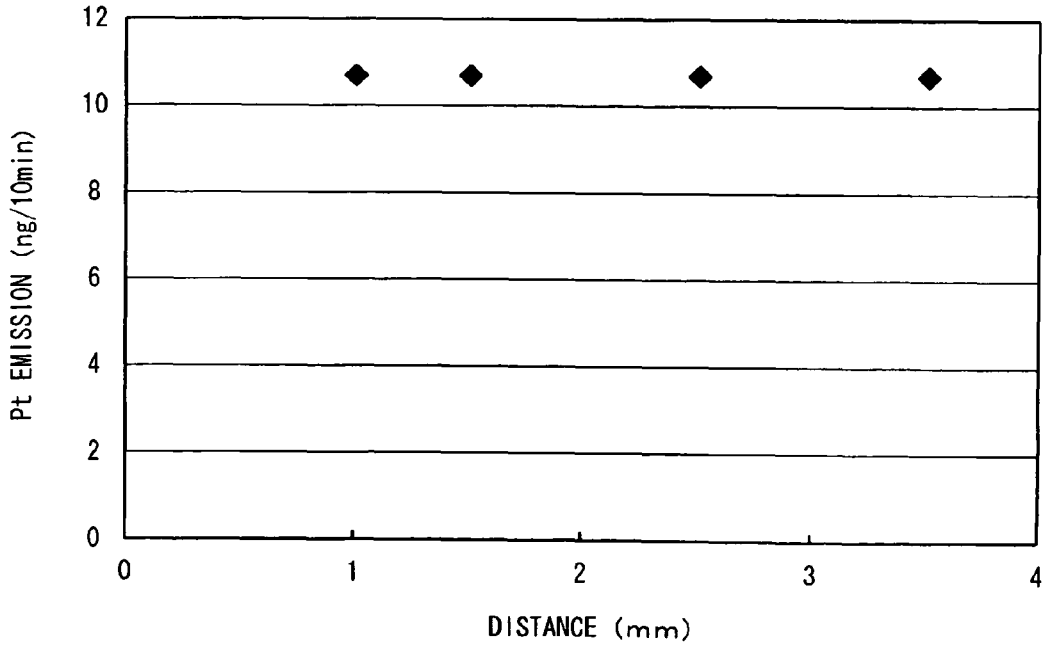
FIG. 7 is a characteristic figure which shows relations of a platinum microparticles emission and a distance between both the first and second electrodes according to said embodiment of the present invention.

Then, a change in an amount of platinum microparticles, which is emitted when a distance D of the flat surface 21 to the outlet opening 31 is variously changed in a range of 1.0 [mm] to 3.5 [mm] (see FIG. 2), will be described with reference to FIG. 7. In addition, a horizontal axis in FIG. 7 shows the distance D (mm), and then a vertical axis in FIG. 7 shows the amount of the platinum microparticles (ng/10 min) emitted in the direction of the arrowed line A through the outlet opening 31. However, the current value is set so as to always become constant, as well as FIG. 6.

As shown in FIG. 7, even if the distance D is changed, a change is hardly seen in the amount of the emitted platinum microparticles. Thus, although all distances D described in FIGS. 1 to 6 are set to 1.5 [mm], there is not an obvious effect to be provided by limiting the distance D.

Thus, as the reason that the smaller the inside diameter ϕ2 becomes the more the platinum microparticles emission increases, for example, an influence of an electric field strength is considered. In other words, the smaller the inside diameter ϕ2 becomes, the easier the electric line of force, extending toward the side of the second electrode 3 from the flat surface 21, pass through the outlet opening 31 in the direction of the arrowed line A. As a result, it is considered that the amount of the platinum microparticles, emitted like a brick in the direction of the arrowed line A, increases.

Figure 8A:
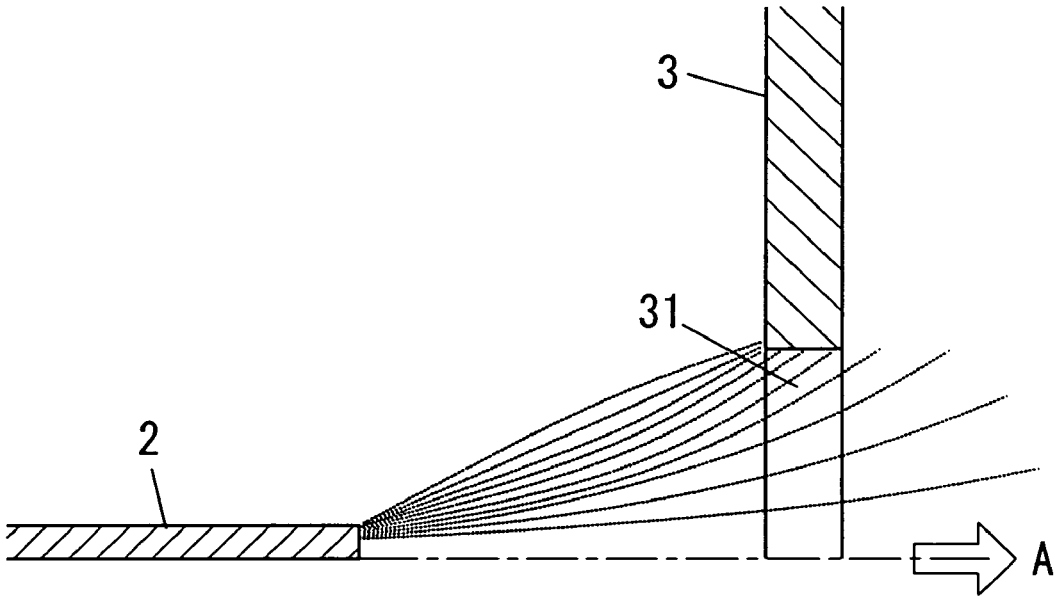
Figure 8B:
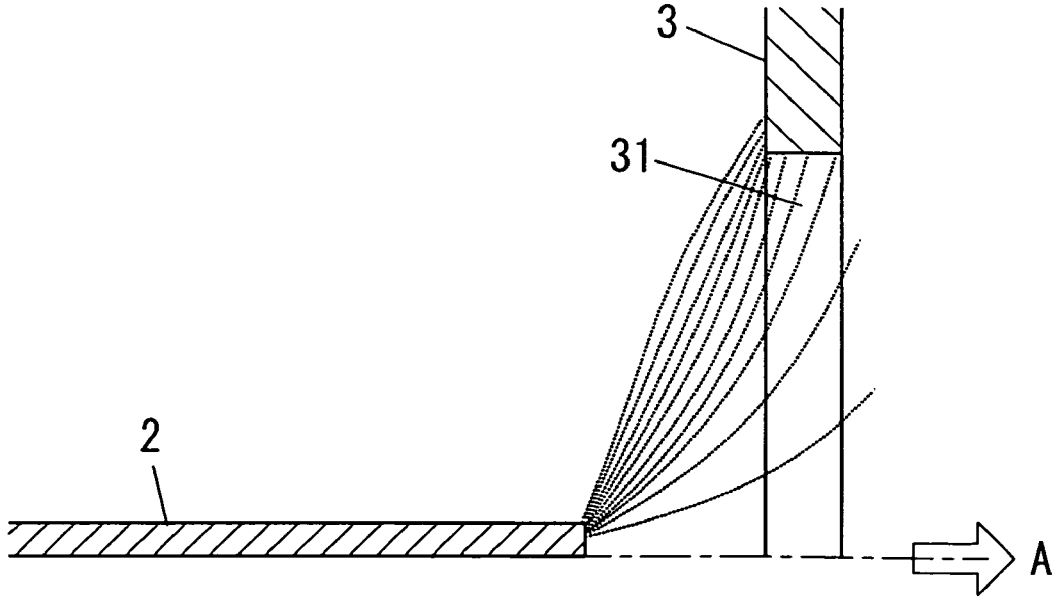

FIG. 8A shows the look of the electric line of force, which is produced between the first and second electrodes 2, 3 when the inside diameter ϕ2 is set to 1.5 [mm]. Then, FIG. 8B shows the look of the electric line of force, which is produced between the first and second electrode 2, 3 when the inside diameter ϕ2 is set to 3.0 [mm]. As can be expected from comparison of FIG. 8A and FIG. 8B, the electric line of force in FIG. 8A, showing the smaller inside diameter ϕ2, passes through the outlet opening 31 in the direction of the arrowed line A more easily than that in FIG. 8B. In addition, the distances D, shown in FIGS. 8A and 8B, respectively, are different from each other.

Hereinafter, an operation of the platinum microparticles generator 1 of the present embodiment will be described. The platinum microparticles generator 1 of the present embodiment is characterized in that the outlet opening 31 has the inside diameter ϕ2 in a range of 1.0 [mm] to 4.5 [mm], under a condition that the first electrode 2 has the outside diameter ϕ1 in a range of 0.03 [mm] to 0.10 [mm]. That is, the platinum microparticles generator 1 can reduce the ozone density by about half without increase or decrease of the current value of the electric discharge, and then can secure the amount of the emitted platinum microparticles being equal to or more than about 75% of a peak value (12 [ng/10 min]). Accordingly, the platinum microparticles generator 1 can emit a sufficient amount of platinum microparticles while restraining generation of ozone.

In addition, if the inside diameter ϕ2 is in a range of 1.5 [mm] to 2.0 [mm], the platinum microparticles generator 1 can secure the amount of the emitted platinum microparticles being equal to or more than about 90% of said peak value, and then can emit a more sufficient amount of platinum microparticles. However, in terms of strength and productivity, it is not preferred that the outside diameter ϕ1 is set to be smaller than 0.03 [mm]. Then, it is not preferred that the inside diameter ϕ2 is set to be smaller than 1.0 [mm], because the platinum microparticles emitted from the first electrode 2 collides with a penumbra of the outlet opening 31 and thereby an emission efficiency decreases.

Then, one end of the first electrode 2 of the present embodiment has a flat surface 21 being perpendicular to a longitudinal direction of the first electrode 2, and thus the platinum microparticles generator 1 can inhibit the platinum microparticles emission from decreasing on a sudden with progress of use time.

Figure 9:
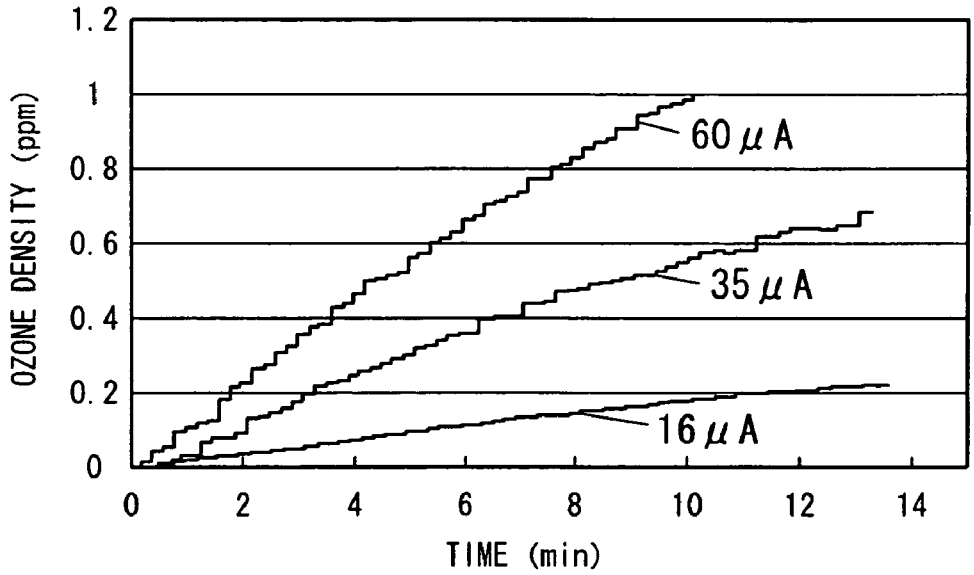
FIG. 9 is a characteristic figure which shows relations of the ozone density and a current value of an electric discharge according to said embodiment of the present invention.
Figure 10:
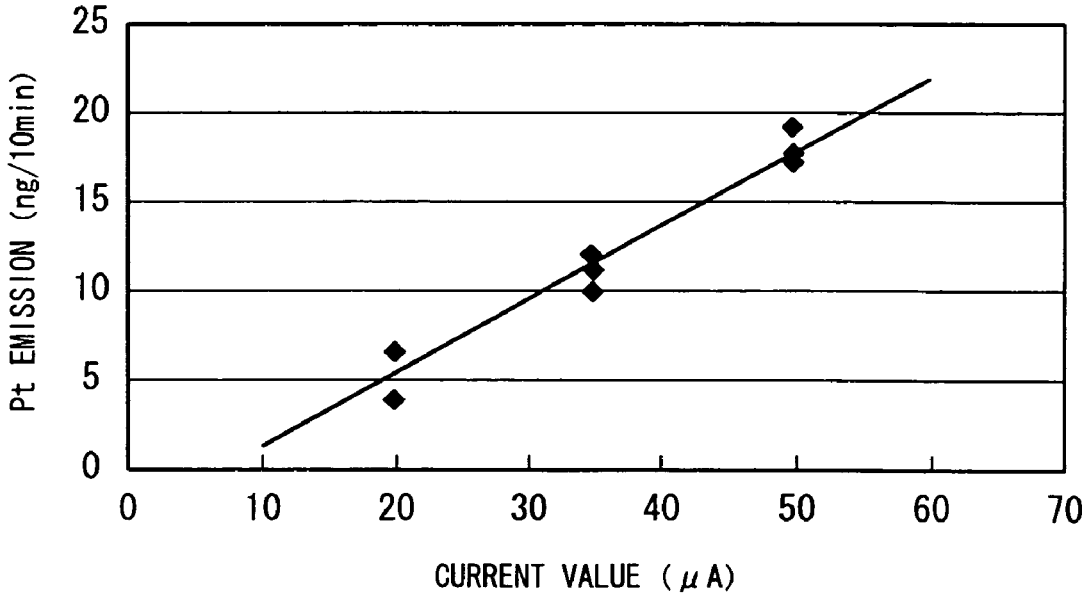
FIG. 10 is a characteristic figure which shows relations of a platinum microparticles emission and the current value of the electric discharge according to said embodiment of the present invention.

By the way, FIG. 9 shows the look of a change in the ozone density to three different kinds of current values of the electric discharge. As can be expected from FIG. 9, the more the current value increases, the more the ozone generation increases. Then, FIG. 10 shows a change in the amount of the emitted platinum microparticles to three different kinds of current values of the electric discharge. As can be expected from FIG. 10, the more the current value increases, the more the platinum microparticles emission increases.

In FIGS. 3 to 8B, the current values are fixed to 35 [μA], and each measurement is performed. However, even if the current values are fixed other value, such as 16 [μA] or 60 [μA], the smaller the outside diameter ϕ1 becomes, the more the ozone generation decreases and the more the platinum microparticles emission increases. In addition, if the outside diameter 1 is set to be equal to or less than 0.10 [mm] and the current value is more than 50 [μA], the first electrode 2 is worn out intensely. Thus, it is preferred that the current value is set to be in a range of 20 [μA] to 50 [μA], and further it is more preferred that the current value is set to about 35 [μA].

It is preferred that the platinum microparticles generator 1 is incorporated in, for example, a hair drier and is used. As explained above, hears produce active oxygen when being exposed to ultraviolet rays, and are damaged by the active oxygen and thus the damage causes to remove hair cuticles. As a reason for that, it is thought that a cystine which is a protein included in hairs is changed to a cysteine acid by the active oxygen. In contract, the platinum microparticles are provided to hairs, and thereby the active oxygen is erased by antioxidant effect of the platinum microparticles. Therefore, the platinum microparticles can prevent the cystine from being changed to the cysteine acid.

It is necessary to emit the platinum microparticles at least equal to or more than 3.6 [ng/10 min], to reduce the damage to hairs caused by the ultraviolet rays enough. It is desirable to secure the platinum microparticles emission equal to or more than 10 [ng/10 min] in an initial state, in order to secure the platinum microparticles emission equal to or more than 3.6 [ng/10 min] in a state where a hair drier is near the end of its own life (for example, it is used for about 500 hours).

Although the present invention has been described with reference to certain preferred embodiments, numerous modifications and variations can be made by those skilled in the art without departing from the true spirit and scope of this invention, namely claims.

The invention claimed is:

1. A platinum microparticles generator comprising:

a linear first electrode containing at least platinum;

a board-shaped second electrode comprising an outlet opening, which is a circular through-hole, located so as to face one end of the first electrode; and an applying means for applying a voltage between the first and second electrodes, wherein the first electrode has an outside diameter in a range of 0.03 [mm] to 0.10 [mm], wherein the outlet opening has an inside diameter in a range of 1.0 [mm] to 4.5 [mm].

2. The platinum microparticles generator as claimed in claim 1, wherein said one end of the first electrode has a flat surface being perpendicular to a longitudinal direction of the first electrode.

3. The platinum microparticles generator as claimed in claim 1, wherein the inside diameter of the outlet opening is set to a value in a range of 1.5 [mm] to 2.0 [mm].

4. The platinum microparticles generator as claimed in claim 2, wherein the inside diameter of the outlet opening is set to a value in a range of 1.5 [mm] to 2.0 [mm].

* * * * *